United States Patent [19]

Bergman et al.

[11] Patent Number: 4,708,522

[45] Date of Patent: Nov. 24, 1987

[54] STORAGE COMPLEX FOR STORING RADIOACTIVE MATERIAL IN ROCK FORMATION

[75] Inventors: Sten G. A. Bergman, Stocksund; K. Ivar Sagefors, Stockholm; Bengt A. Åkesson, Frölunda, all of Sweden

[73] Assignee: Boliden Aktiebolag, Stockholm, Sweden

[21] Appl. No.: 823,495

[22] PCT Filed: Apr. 9, 1985

[86] PCT No.: PCT/SE85/00164

§ 371 Date: Nov. 25, 1985

§ 102(e) Date: Nov. 25, 1985

[87] PCT Pub. No.: WO85/04751

PCT Pub. Date: Oct. 24, 1985

[30] Foreign Application Priority Data

Apr. 10, 1984 [SE] Sweden ..... 8401994

[51] Int. Cl.[4] ..... G21F 7/00

[52] U.S. Cl. ..... 405/55; 405/53; 405/128

[58] Field of Search ..... 405/55, 128, 129, 52, 405/53

[56] References Cited

U.S. PATENT DOCUMENTS

| | | | |
|---|---|---|---|
| 4,192,629 | 3/1980 | Hallenius et al. | 405/128 |
| 4,363,563 | 12/1982 | Hallenius et al. | 405/55 |
| 4,474,506 | 10/1984 | Sagefors | 405/55 |

*Primary Examiner*—Dennis L. Taylor

*Attorney, Agent, or Firm*—Burns, Doane, Swecker & Mathis

[57] ABSTRACT

The present invention relates to a structure for storing radioactive material in rock, having a body (4) for accommodating radioactive material, the body (4) being encompassed by rock around which a cavity (3) may optionally be formed, there being arranged in the cavity a barrier (5) comprising a water-swelling elastoplastic material. The body (4) includes a substantially vertical central shaft (8), a vertical shaft (10) of annular cross-section and extending concentrically with the central shaft (8), and a plurality of vertical drifts (12) located at a distance from the center axis of the central shaft (8). The body also has arranged therein a plurality of vertically located strata for storing radioactive material, each stratum comprising a plurality of tubular adits (9) which extend radially from the center axis of the central shaft (8) and the longitudinal axes of which form an acute angle with the center axis of the central shaft (8), the shaft (10) and the vertical drifts (12) being connected together in the proximity of the upper and lower parts of the central shaft.

13 Claims, 6 Drawing Figures

6
7
32
31
4
30
13
8
13
14
16
B
B
9
12
29
10
34
28
9
9
11
12
34
11
9
9
10
10
15
15
28
8

STORAGE COMPLEX FOR STORING RADIOACTIVE MATERIAL IN ROCK FORMATION

TECHNICAL FIELD

The invention relates to a structural complex for storing radioactive material in rock, and particularly to a structural complex for a long-term storage of spent nuclear fuel obtained from nuclear reactors and radioactive waste formed when reprocessing spent nuclear fuel.

The object of the invention is to provide a structural complex for storing radioactive material in rock in which said material can be stored for an extremely long period of time without resulting in the contamination of ground water.

The fuel elements used in nuclear reactors must be removed after a certain period of time and replaced with fresh fuel elements. The fuel contains uranium, plutonium and fission products. The uranium and plutonium can be recovered by reprocessing the spent product and re-used as fuel. Reprocessing of the spent fuel results in a waste which, in addition to a large number of fission products also contains minor quantities of uranium and plutonium and other transuranic elements. The majority of the waste products are highly radioactive and decompose to gradually form stable basic substances. Various kinds of radiation is emitted during the decomposition period. The half-life of the various waste products differs widely, and may range from fractions of a second to millions of years. The half-life of Plutonium-242 for example is 380,000 years.

Since powerful radioactive radiation is dangerous to living organisms, it is necessary to store such highly radioactive waste safely for very long periods of time (thousands of years) in a manner which isolates it from all living matter (the biosphere).

In the aforesaid reprocessing of spent fuel, the highly radioactive waste is obtained in the form of an aqueous solution, which is concentrated to the highest possible extent. This solution is not suited for long-term storage, and consequently is converted to solid form after being left to cool for a suitable length of time. Vitrification is considered the best method of converting the solubilized waste to solid form. This requires the waste to be vaporized, calcined and then heated to a suitable temperature in the presence of a vitrifying agent. The resultant glass melt is poured into containers, which must then be placed in a suitable storage complex.

It has been suggested that the solidified highly radioactive waste shall finally be stored in rock caves at a great depth in basement rock. One such proposed storage complex comprises a waste-receiving system located at ground surface level. A vertical transport tunnel is drilled from this surface station deep into the basement rock and from the lower part of this vertical tunnel there is drilled a horizontal tunnel. A plurality of vertical walls are drilled in the floor of this horizontal tunnel. The waste containers are intended to be transported with the aid of automatic transporters through the aforesaid tunnels and lowered as plugs in the bore holes extending vertically from the floor of the horizontal tunnel. As the bore holes are filled with waste containers, and encapsulated with or packed in bentonite clay, the upper regions of respective holes are sealedoff with concrete for example.

The expedient of capsulating fuel rods which have not been reprocessed directly from intermediate storage locations and storing the same in a rock-cave complex has also been discussed. Radioactive material storage complexes are known from the Swedish Patents Nos. SE-C-7613996-3; SE-C-7707639-6; SE-C-7700552-8; SE-C-7702310-9 and SE-A-8305025-2. Radioactive material can be stored in the complexes disclosed in these patent specifications for long periods of time without water being able to enter the complex.

The complexes forming part of the present state of the art include a solid, hollow body whose interior forms the storage space for the radioactive material. The hollow body is placed in an inner cavity located in the basement rock and having larger dimensions than the hollow body, the body being placed in the cavity so that no side of the body is in contact with the cavity walls. The space located between the hollow body and the cavity walls is filled with an elastoplastic deformable material. Arranged in the rock externally of the inner cavity is a further cavity which fully encompasses the inner cavity and which is also filled with a plastically deformable material.

The hollow body is suitably constructed from concrete and has an ellipsoidal or spherical shape. The hollow body obtains in this way an extremely high mechanical strength against the action of external forces.

The elastoplastic material, which swells in water, surrounding the hollow body and filling the outer cavity or void suitably comprises clay or bentonite. Clay is particularly suitable for the purpose intended, since it is able to bind radioactive fission products by ion-exchange reactions and is but slightly permeable to water, and because of its plasticity can be formed without cracking.

The hollow body can be provided on the outer surface thereof with a layer of heat insulating material, in which coolant circulation channels can be provided. The walls of the inner cavity can also be provided with a similar heat-insulating layer.

The interior of the hollow body is suitably divided with the aid of horizontal partitions into a plurality of superposed chambers, which are provided with ports through which radioactive material can be placed into the chambers. This enables the space available in the hollow body to be utilized more efficiently and also facilitates the introduction and removal of the radioactive material into and out of respective chambers.

A shaft or drill-hole accommodating monitoring instruments, such as humidity gauges, thermometers, and devices for measuring radioactive radiation, may be provided in the rock located between the first and second cavity.

The bottom of the outer cavity is suitably conically curved downwardly. This facilitates the introduction and compaction of clay or some other water-swelling elastic material in the bottom of the outer cavity.

The rock mass located between the inner and the outer cavity will be totally embedded in the water-swelling, elastoplastic material. Although this material is sufficiently load-supporting in itself to prevent the rock mass from sinking thereinto, as an additional precaution thereagainst it may be suitable to stabilize the material by adding some suitable stabilizing substance in the region beneath the rock mass.

Demands have been made, however, for complexes which have a higher degree of safety with respect to the flow of water therethrough, such as to reduce this through-flow and therewith minimize contamination of the ground water.

In SE-A No. 8305025-2 there is described a complex for storing radioactive material in rock which includes at least one first cavity formed in solid material and the interior of which forms a space for the storage of radioactive material, wherein there is formed in the rock externally of the first cavity an optional outer cavity which fully encompasses the first cavity and which is filled with a water-swelling elastoplastic material, and wherein there extends around the complex a tunnel which is preferably of helical configuration and from which access can be had during construction and supervision of the inner parts of the complex, and wherein there is disposed around the complex, preferably via the helical tunnel, a large number of substantially vertical bore holes which form at least one outer "cage" around the complex, the purpose of which cage is to carry away water moving towards and away from the complex.

Furthermore, SE-A No. 8305025-2 discloses the possibility of cooling stored material with the aid of convection air currents, wherein there is provided in the central space a number of vertical holes for the storage of radioactive material and a number of blank or empty holes for return air. All of the vertical holes are interconnected so as to enable air to circulate up through the vertical holes filled with radioactive material and down through the empty holes.

DISCLOSURE OF THE PRESENT INVENTION

It has now been found possible to achieve dense packaging in a storage of radioactive material while cooling with freely flowing air (natural convection) and/or with a forced air flow. This reduces the heat load on surrounding rock.

The complex according to the invention also includes a substantially closed airflow system for ventilation cooling. The complex also affords optimum access for filling and inspection purposes and for the recovery of stored material.

The present invention is characterized by at least one body of solid material which forms a storage space for the radioactive material; a substantially vertical shaft arranged centrally in the body of the complex; a vertical ring-shaped shaft concentrical with the central shaft; a number of vertical drifts spaced from the geometric centre axis of the central shaft; and a plurality of vertically arranged strata for the storage of radioactive waste, each stratum comprising a plurality of tubular adits which extend radially from the centre axis of the central shaft and the respective geometric axis of which form an acute angle with the centre axis of said central shaft, and in which complex the ring-shaped shaft and the vertical drifts are connected together in the region of the upper and the lower part of the central shaft.

Additional characteristic features are set forth in the claims pertaining thereto.

The invention will now be described in more detail with reference to the accompanying drawings, in which FIG. 1 is a vertical sectional view of a structural complex according to the present invention;

Figure 1:
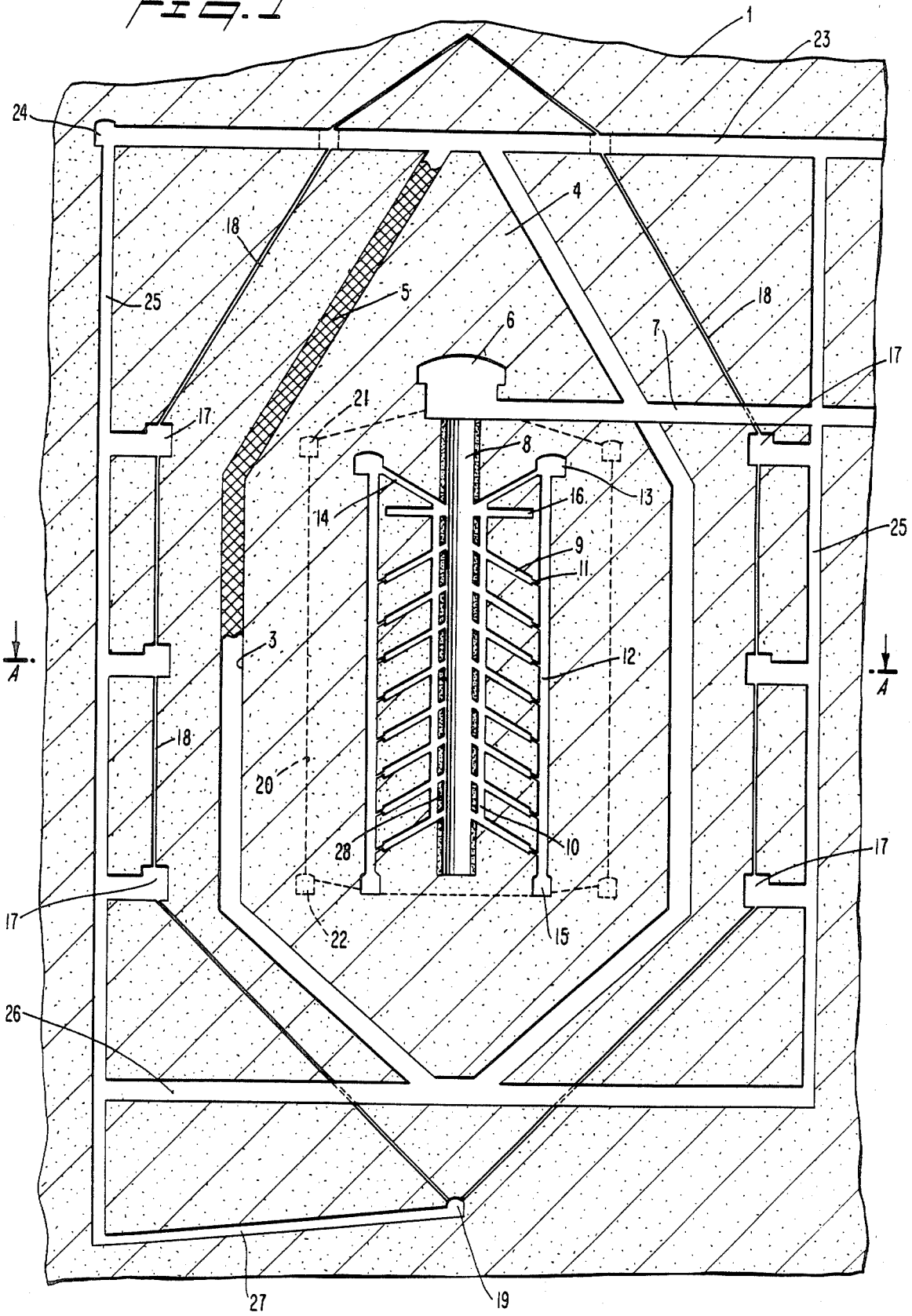

In the drawings the reference 1 identifies the bedrock in which the storage complex is located at a given depth beneath the surface of the ground (not shown). Formed in the bedrock is an inner cavity, the contours of which are shown at 3. A body 4 which is perforated with holes and the interior of which forms a storage space for radioactive material is arranged in the bedrock within the cavity 3, in a manner such that no part of the outer surface of the body 4 is in contact with the cavity wall. The space located between the walls of the cavity 3 and the body 4 is filled with clay 5, such as bentonite. The cavity 3 together with the bentonite shield 5 may also be formed in a natural layer of clay in the bedrock against which the storage complex is constructed. Highly compressed bentonite blocks can be introduced into the clay shield 5 as a stabilizing means. Loose bentonite can be blown onto the rough rock walls, this bentonite subsequently migrating into the rock where it swells and seals-off cracks therein.

The cavity 3 is fully encompassed by the bedrock 1.

The cavity 3 of the illustrated embodiment is preferably circular when seen in horizontal section. An elliptical configuration may be more suitable, however, when there is a large difference between the largest and the smallest horizontal principal stress. The defining walls of the cavity 3 seen in horizontal section form herewith two concentrical circles or ellipses. The cavity 3 is formed in accordance with known mining techniques, with upwardly rising cut-and-fill sloping, wherewith access tunnels are formed at suitable levels.

Provided in the upper portion of the body 4, which has a cylindrical shape with conical top and bottom portions, is a receiving chamber 6 which communicates with a receiving station (not shown) at ground level through a horizontal tunnel 7. The tunnel 7 is suitably provided with a plurality of feed valves (not shown) and provides means for transporting the radioactive material into the perforated body 4. The interior of the body 4 includes a central, vertical cylindrical shaft 8, from which a plurality of cylindrical bores or tubular also known as a cylindrical or tubular adits extend outwardly downwardly, or outwardly upwardly at angles between 30° and 60°. This angle is the angle subtended by the longitudinal axis of the cylindrical bore 9 and a horizontal plane through the storage complex. In the illustrated embodiment the cylindrical bores 9 are arranged in layers of 12 bores 9 to each layer, two mutually adjacent layers being displaced 15° in relation to one another. The bores 9 open upwardly into an annular vertical channel 10 located concentrically outside the shaft 8, and open downwardly into vertical drifts 12 via smaller throughpassing holes 11. The annular channel 10 and the drifts 12, which may all be of cylindrical or conical configuration, are upwardly connected with one another via an annular horizontal tunnel 13, from which the drifts 12 are drilled. The connection between the tunnel 13 and the channel 10 comprises a plurality of sloping tunnels 14. The drifts 12 are connected together at their lower portions via an annular tunnel 15. Formed above the layers of bores 9 are a number of horizontal adits 16, which are intended to accommodate highly active, non-nuclear-fuel material, such as reactor vessels or the like. Located externally of the cavity 3 of the complex is a plurality of horizontal annular or sloping helical tunnels 17, between which vertically extending drill holes 18 are formed at a distance of about 1–2 m apart, to form a hydraulic cage, i.e. a curtain of drill holes 18, which conduct away water flowing in the bedrock towards and away from the complex. The drill holes 18 depart from a point above the complex and terminate in a pump room 19 located centrally beneath the complex. An inner hydraulic cage can be arranged inthe same manner between the cavity 3 and the central store in the body 4, by means of drill holes 20, via an upper and a lower annular tunnel 21 and 22 respectively and the receiving chamber 6 and the annular tunnel 15.

The whole of that part of the body 4 defined by the vertical drifts 12 may also comprise an artificial structure of steel and concrete. In this case there is formed between the tunnel levels 15 and 16 a cavity in the form of an upright cylinder, in which the artificial structure is placed. Access is had to the structure during construction by means of a tunnel 23 which extends inwardly towards the upper part of the complex, and an upper annular tunnel 24 from which vertical drifts 25 are formed to provide access to the sites of tunnels 17, to facilitate construction thererof. Access tunnels extend from the tunnels 17, for mining and filling the cavity 3. The drifts 25 serve as transport tunnels for removal of the rock mined. To enable part of the rock material to be removed when forming the lower part of the cavity 3, there is provided beneath the storage complex a horizontal tunnel 26. Vertically movable transport means, in the form of elevators and paternosters, are arranged in the drifts 25.

Upon completion of the storage complex, a minor tunnel 27 is formed from the pump room 19 to one of the drifts 25, through which water can be lifted and carried away through conduits (not shown).

Figure 3:
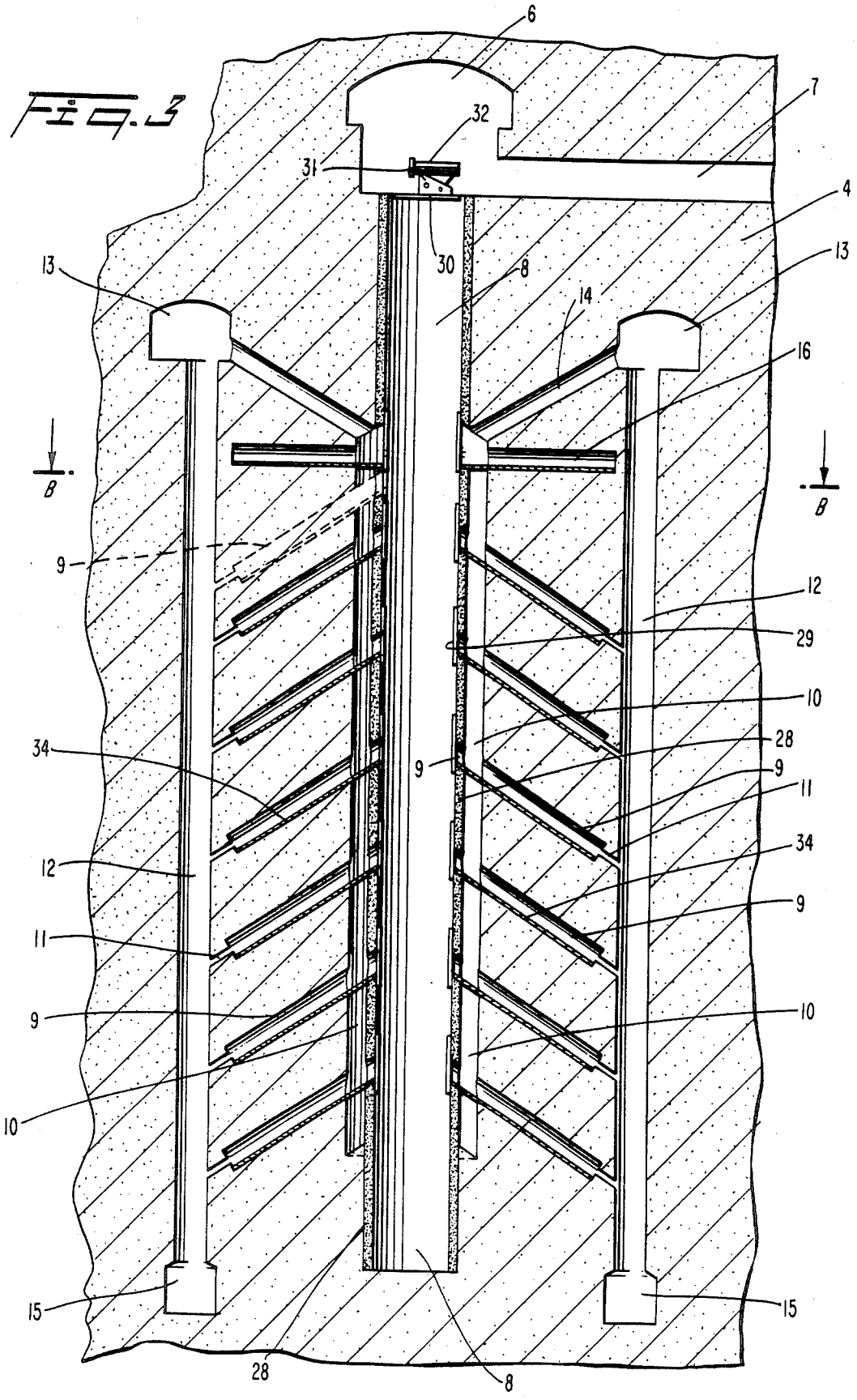
FIG. 3 illustrates a central store in vertical section according to FIG. 1.
Figure 5:
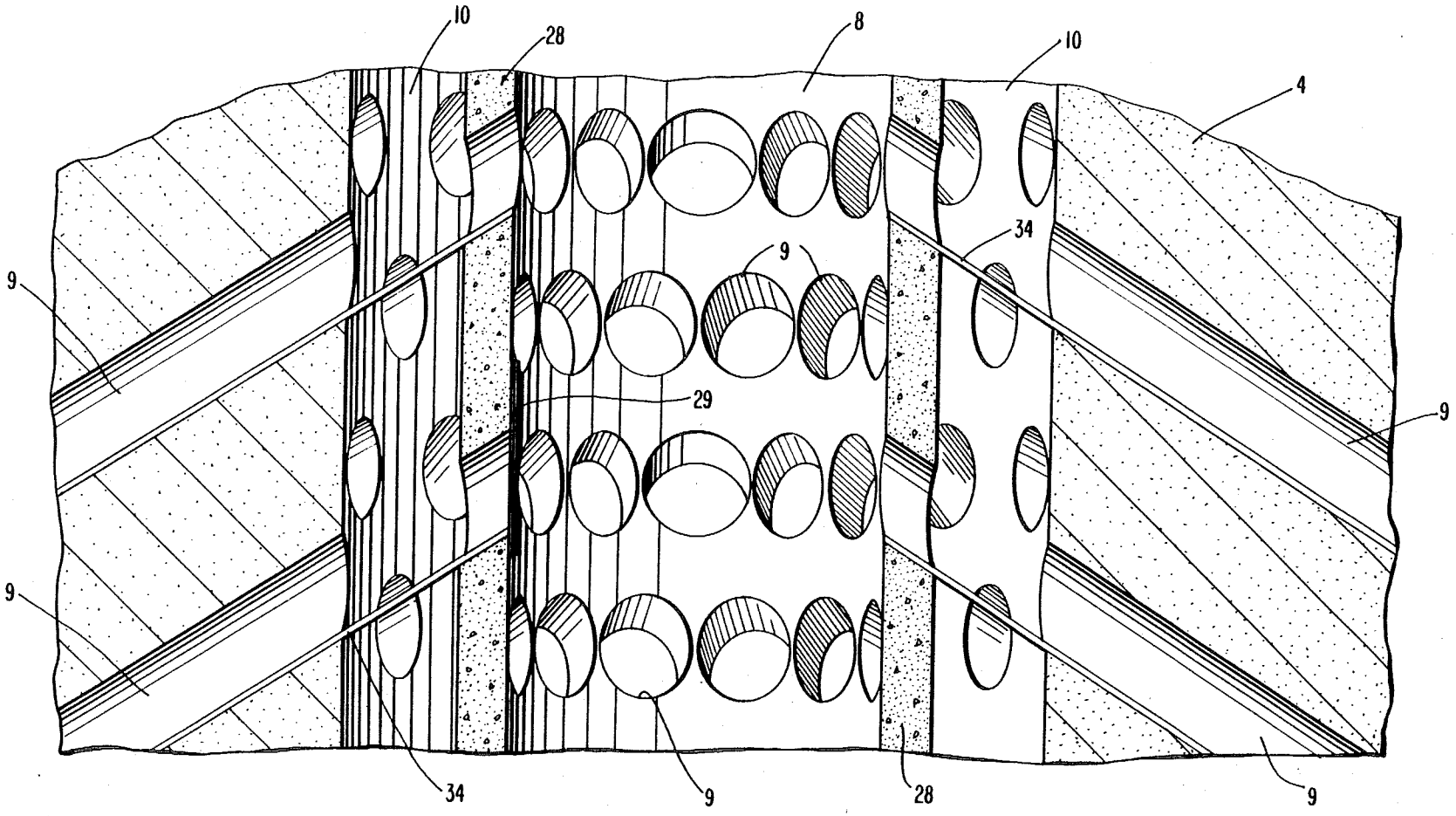
FIG. 5 is a vertical section showing in larger scale a part of the central store.
Figure 6:
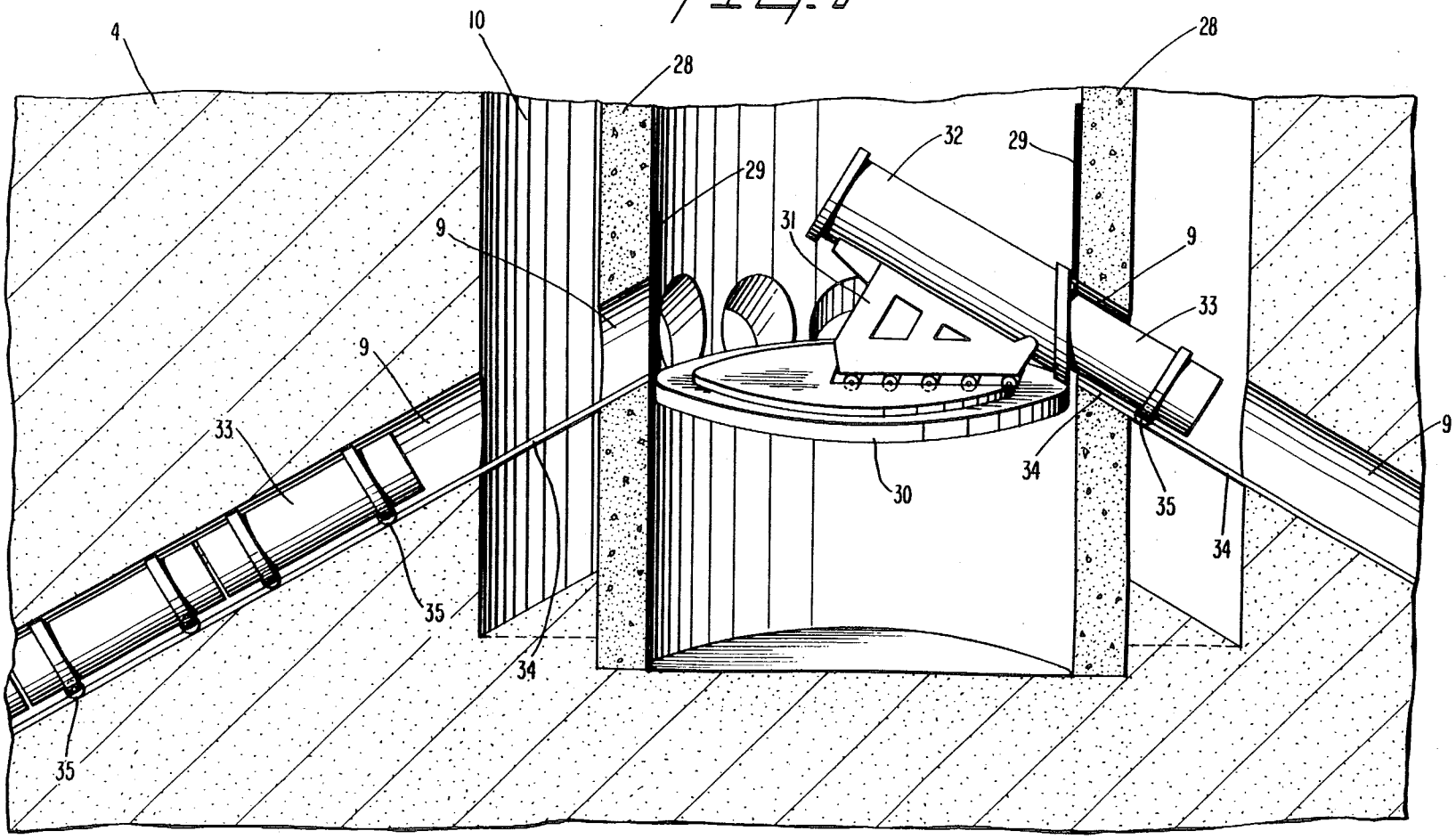
FIG. 6 illustrates an arrangement for introducing material into the store and removing material therefrom.

As will be seen from the vertical sectional views of FIG. 1, FIG. 3 and FIG. 5, the bores 9 extend through the channel 10 and open into the outer wall 28 of the shaft 8. The outer wall 28 comprises a concrete structure in the rock. The shaft 8 is drilled with a full-face drilling bit, wherewith the width of the shaft and the width of the channel 10 are formed simultaneously as a vertical cylindrical hole. The concrete wall 28 with bores 9 is then constructed with the aid of a slipform. The bores 9 are connected to the shaft 8 by means of raisable and lowerable flaps 29.

Arranged in the central shaft 8 is a vertically movable platform 30 which can be moved vertically, by means of hoist machinery (not shown) from the receiving chamber 6 to a location which is at least level with the lowermost layer of bores 9. Arranged on the platform 30 is a charging unit 31 which comprises a cylinder 32, capable of being rotated from a position in which its geometrical longitudinal axis extends horizontally to a position in which said axis is inclined at an angle corresponding to the angle at which the bores 9 are inclined to the horizontal plane, i.e. so that the longitudinal axis of the bores 9 and the longitudinal axis of the cylinder 32 can be placed parallel with one another. Winch machinery is mounted in the cylinder 32. When charging a bore 9, a capsule 33 is placed in the receiving chamber 6, introduced into the cylinder 32 and connected to the winch and drawn into said cylinder. The platform is then moved to the desired level and to a bore 9 located thereon, whereafter the flap 29 is raised and the capsule 33 lowered into the bore. The distance between the wall 28 and the bore 9 in the bedrock is bridged herewith by rails 34, on which wheels 35 mounted on the capsule 33 run so as to lower the capsule 33 in a friction-free manner. The rails 34 suitably extend through the entire length of the bore 9. This also enables capsules 33 to be readily lifted from the bores 9 and moved to another layer or from the storage complex for further re-processing after intermediate storage for example.

The heat given off by the stored material passes, through convection, up out of the bores 9 and into the channel 10, from where it passes into the annular tunnel 13, via the tunnels 14. Subsequent to being cooled in this way the air will then pass down through the drifts 12 and be drawn by suction through the holes 11 into the bore spaces 9. Because the channel 10 is closed to the shaft 8, no air, which may be contaminated, will come into contact with said shaft. As a result of the curtain of drill holes 18, water running through macrocracks and microcracks in the rock will be conducted around the complex or down to its bottom level 19, from which the water can be removed by means of pumps and a conduit arrangement, if so required. In certain cases the drill holes may be charged with explosives and exploded to form cracks (so-called presplitting) extending between the drill holes. This should enable maximum cracking to be obtained towards and between the drill holes, even though the calculations made indicate that the drill holes afford in themselves a fully sufficient hydrological barrier.

In the event that the storage complex is totally sealed off and becomes filled with water over the passage of a long period of time, the drill holes 18 will serve as a shunt for the water penetrating towards the central store, since the water strives to find the path of least resistance, rather than attempting to pass through rock and the bentonite barrier.

The illustrated transport tunnel 7 may be connected directly to a plant for re-processing radioactive nuclear fuel. This reduces the risks associated with the transport of radioactive waste. The tunnel, however, is not essential to the storage complex according to the invention. Thus, the various aforementioned shafts may open at the top thereof into some suitable structure for receiving the radioactive waste. The structure may be located on ground level or blasted in the rock.

The body 4 may also have formed therein a vertical shaft or drill hole which extends out to the horizontal tunnel 7. This shaft or drill hole may accommodate measuring equipment (not shown) for measuring temperature, humidity and radioactive radiation. These measuring devices may be connected through lines with indicating means arranged in a suitable monitoring station.

The storage complex can be constructed with the aid of known mining methods. Firstly, working and transport tunnels and shaft are driven in the rock to those locations where the two cavities are to be located. These two cavities may be mined from the bottom thereof and upwardly. As the rock mass is removed the exposed cavity 3 is progressively filled with a mixture of bentonite and sand. This bentonite-sand mixture is compacted so that no voids remain therein. The clay can be further stabilized in a region located furthest down in the cavity 3 by adding a suitable stabilizing material, such as silica, so that the mixture is better able to support the load exerted by the rock mass 4.

Any cracks in the rock masses located nearest the cavity 3 may be sealed by injecting concrete or some other sealing material, such as plastics material and dry bentonite powder.

Figure 2:
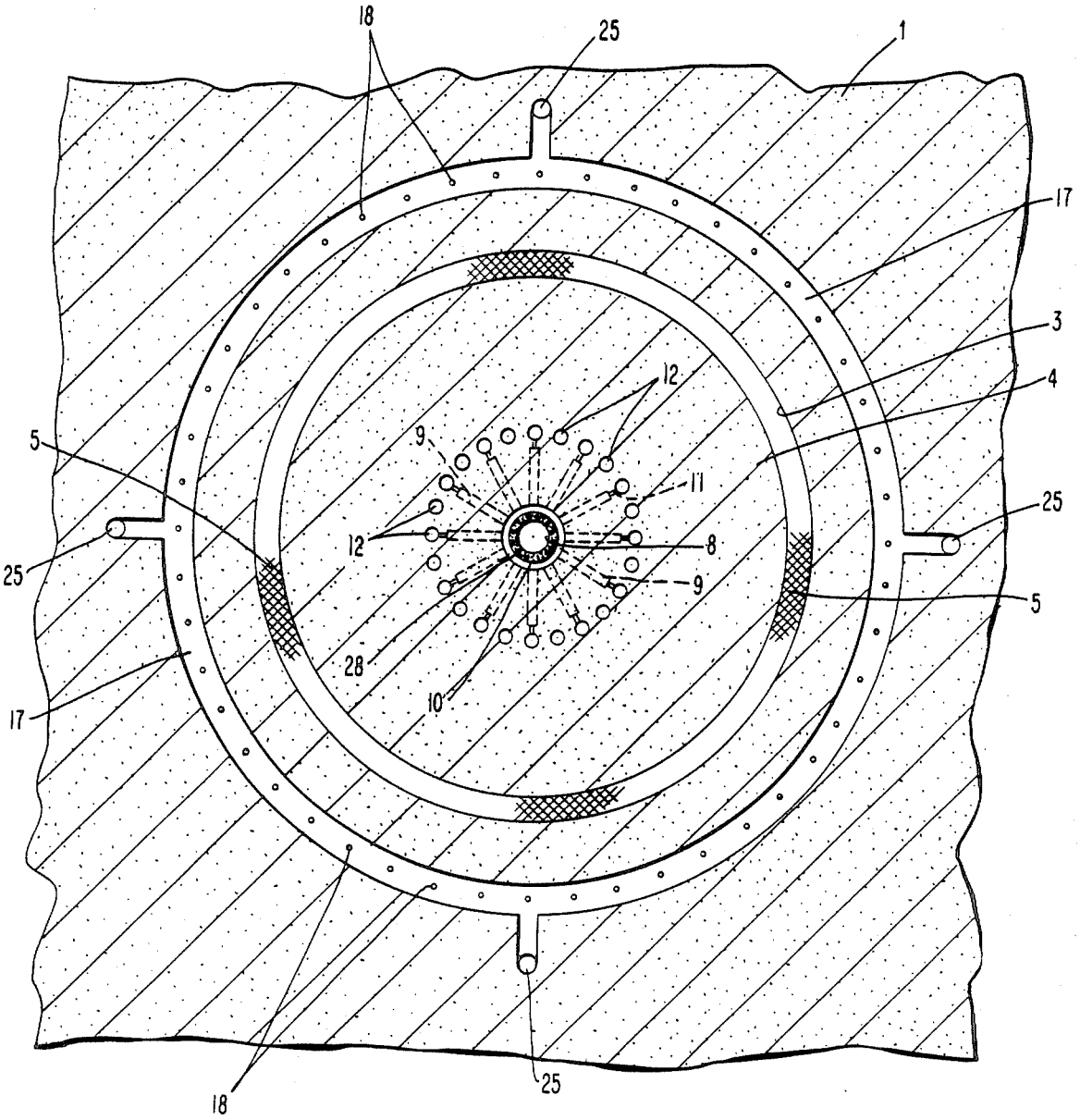
FIG. 2 is a horizontal sectional view through the complex illustrated in FIG. 1, taken on the line A—A.
Figure 4:
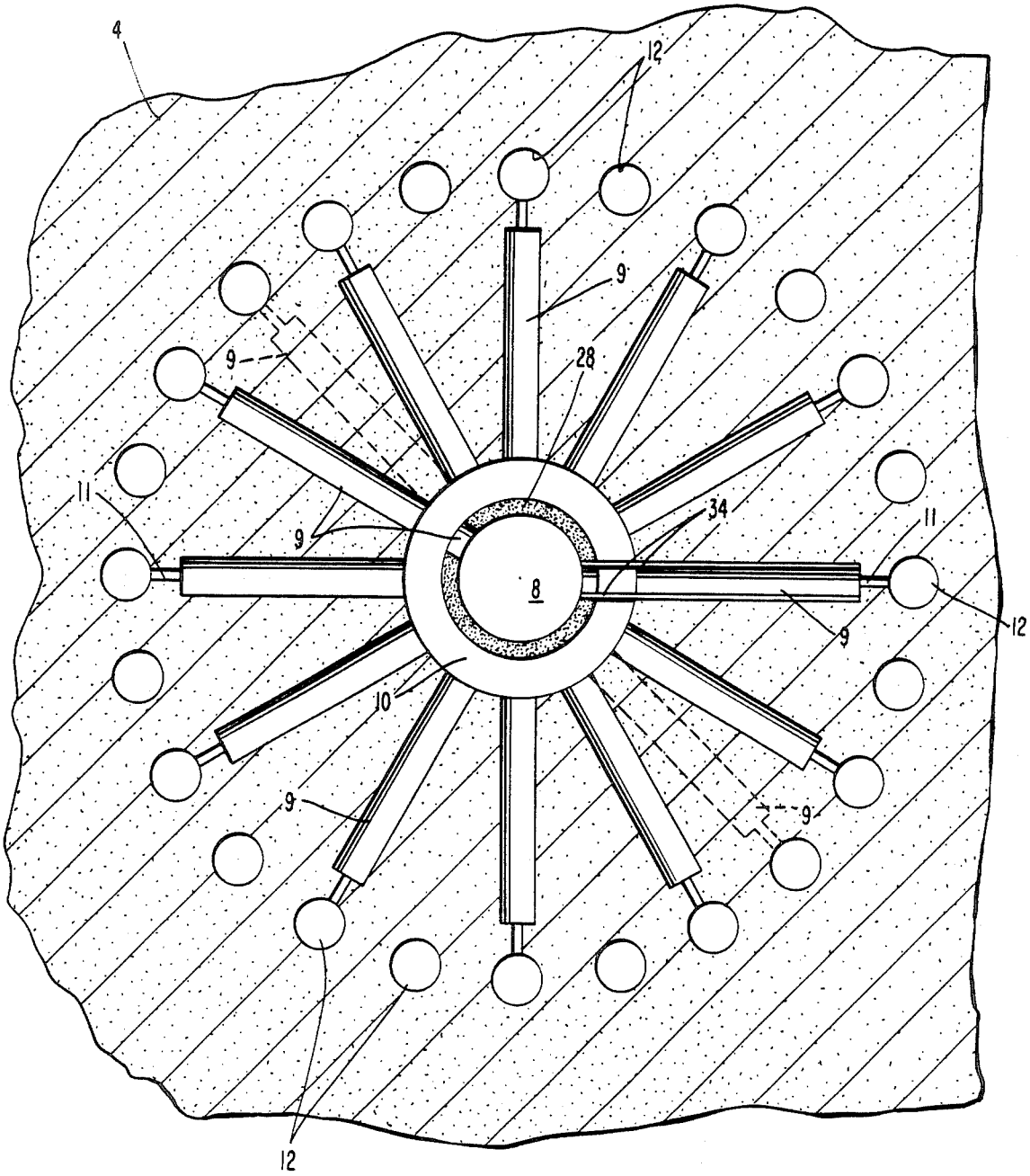
FIG. 4 is a horizontal sectional view of the central store illustrated in FIG. 3, taken on the line B—B.

As illustrated in FIGS. 2 and 4, the drifts 12 are placed in a circular array, thereby to afford maximum cooling of the rock material. Because the radioactive material is placed so that air can pass through the bores 9 and the channel 10, primary cooling is also achieved, which means that the rock material is subjected to a smaller load than if all the heat should be dissipated through the rock material.

The central parts of the storage complex as a whole can be clad with total-welded steel plate, so as to stabilize the rock mass and obtain a substantially gas-tight construction. During the ventilation period the bores 9 may be isolated fromthe surrounding rock by means of a mineral-wool cylindrical plug. This plug is removed upon completion of the forced ventilation period and upon sealing of the storage complex. The plugs can then be dumped in the lower part of the central shaft 8.

Should the rock shift, settle or re-form externally of the storage structure, these rock movements will primarily be absorbed by deformation of the clay shell 5. If the clay shell is sufficiently thick, these deformation forces will not be transmitted to the inner body 4 to any appreciable extent. Consequently, not even highly powerful deformation forces, such as those cause by earthquakes for example, can act upon the storage structure to an extent such as to fracture the body 4.

The storage structure is suitably placed at a great depth in the bedrock. The storage structure of the illustrated embodiment has a diameter in horizontal section of about 170 m, while the actual central storage body has a diameter of about 40 m. Externally of the body extends a rock mass over a distance of about 40 m, to the clay or bentonite barrier. Outwardly of the barrier is a further rock mass (15–20 m) terminating at the building tunnels 17, each of which has a width of 4–8 m.

Depending upon whether the storage structure is to be used for final storage purposes of intermediate storage, and also as to how the structure is ventilated for cooling the radioactive material, the illustrated structure is able to accommodate up to 1500 tons of radioactive waste. The temperature within the rock chamber can be kept low when used for intermediate storage, provided that the chamber is well ventilated.

In certain cases it may be desirable to introduce cooling water or some other medium into the storage structure, depending upon the temperatures reached, the density to which the waste material is packed, and other factors. In this case, heat exchangers may be placed in the tunnel 13 or in the proximity thereof. The air circulating in the storage structure is then cooled prior to flowing down in the drifts 12.

We claim:

1. A structural complex for storing radioactive material in rock comprising:

(a) at least one body of solid material which forms a storage space for the radioactive material;

(b) a substantially vertical shaft arranged centrally in the body of solid material;

(c) a vertical annular shaft concentric with the central shaft:

(d) a plurality of vertical drifts located at a distance from a central axis of the central shaft, the vertical annular shaft and the vertical drifts being connected in the proximity of an upper and a lower part of the central shaft; and (e) a plurality of strata mutually spaced in the vertical direction for storing radioactive waste, each stratum comprising a plurality of tubular bores, each bore having a central axis, the tubular bores extending radially from the center axis of the central shaft such that the center axes of the bores form an acute angle with the center axis of the central shaft.

2. The structure of claim 1 wherein the tubular bores are connected with the vertical drifts via through-passing holes.

3. The structure of claim 2 wherein the throughpassing holes have a smaller diameter than the diameter of the tubular bores.

4. The structure of claim 1 wherein the body is encompassed by a cavity filled with an elastoplastic deformable material.

5. The structure of claim 4 wherein a vertical curtain of drill holes is arranged around the cavity, said drill hole forming and outer cage around the complex so as to collect and carry away water from the vicinity of the complex.

6. The structure of claim 4 wherein the elastoplastic deformable material is bentonite clay.

7. The structure of claim 1 wherein the tubular bores are constructed outwardly and downwardly from the central shaft.

8. The structure of claim 1 wherein the tubular bores are sealed from the central shaft by raisable and lowerable flaps.

9. The structure of claim 8 wherein a platform is located in the central shaft and wherein the structure includes means for raising and lowering the platform.

10. The structure of claim 9 wherein the platform includes a charging unit for loading and unloading radioactive material in the bores.

11. The structure of claim 10 wherein the bores are provided with rails to facilitate loading and unloading of the radioactive material.

12. The structure of claim 1 wherein a vertical curtain of drill holes is arranged within the body of solid material and around the vertical annular shaft, said drill holes forming an inner cage so as to collect and carry away water within the body.

13. The structure of claim 1 wherein a receiving chamber is located at the top of the central shaft, said receiving chamber being connected to the surface by a horizontal tunnel.

* * * * *